US010334956B2

(12) United States Patent
Lobry et al.

(10) Patent No.: US 10,334,956 B2
(45) Date of Patent: Jul. 2, 2019

(54) ONE-PIECE MATTRESS SUSPENSION DEVICE

(71) Applicant: TOURNADRE SA STANDARD GUM, Bourges (FR)

(72) Inventors: Jacques Lobry, Bourges (FR); Géraud Cailley, Bourges (FR); Pascal Lobry, Bourges (FR)

(73) Assignee: TOURNADRE SA STANDARD GUM, Bourges (FR)

( * ) Notice: Subject to any disclaimer, the term of this patent is extended or adjusted under 35 U.S.C. 154(b) by 480 days.

(21) Appl. No.: 15/140,971

(22) Filed: Apr. 28, 2016

(65) Prior Publication Data

US 2016/0316924 A1 Nov. 3, 2016

(30) Foreign Application Priority Data

Apr. 30, 2015 (FR) ..... 15 53944

(51) Int. Cl.

| | |
|---|---|
| ***A47C 21/06*** | (2006.01) |
| ***A47C 23/00*** | (2006.01) |
| ***A47C 9/02*** | (2006.01) |
| ***A47C 19/02*** | (2006.01) |

(52) U.S. Cl.

CPC ..... *A47C 21/06* (2013.01); *A47C 19/02* (2013.01); *A47C 23/002* (2013.01)

(58) Field of Classification Search

CPC ..... A47C 21/06; A47C 19/02; A47C 23/002
See application file for complete search history.

(56) References Cited

U.S. PATENT DOCUMENTS

| | | | | |
|---|---|---|---|---|
| 122,111 | A * | 12/1871 | Duffy | A47C 23/002 5/255 |
| 6,170,808 | B1 * | 1/2001 | Kutschi | A47C 27/065 267/107 |
| 6,477,727 | B1 * | 11/2002 | Fromme | A47C 23/002 267/81 |
| 2002/0163114 | A1 * | 11/2002 | Lobry | A47C 23/002 267/142 |

(Continued)

FOREIGN PATENT DOCUMENTS

| | | |
|---|---|---|
| DE | 202007000158 U1 | 3/2007 |
| DE | 102012107887 B3 | 11/2013 |

(Continued)

*Primary Examiner* — Eric J Kurilla
(74) *Attorney, Agent, or Firm* — The Webb Law Firm

(57) ABSTRACT

The invention relates to a one-piece suspension device for interposing between a mattress and a support structure. The device includes a platform defining a bearing plane for the mattress, a fastener point for fastening to the support structure, and a resilient section. The resilient section is more resilient than the platform in a direction perpendicular to the bearing plane and it is interposed between the platform and the fastener point in the direction perpendicular to the bearing plane to absorb compression forces. The one-piece suspension device is shaped such that any axis perpendicular to the bearing plane and passing through the one-piece suspension device intersects the one-piece suspension device along a single intersection segment. The resilient section has at least two elastic hinges with different flexibilities.

18 Claims, 6 Drawing Sheets

(56) References Cited

U.S. PATENT DOCUMENTS

| | | | | |
|---|---|---|---|---|
| 2004/0111799 | A1* | 6/2004 | Bock | A47C 23/00 5/600 |
| 2004/0123384 | A1* | 7/2004 | Fromme | A47C 23/002 5/255 |
| 2004/0253415 | A1* | 12/2004 | Lobry | A47C 23/002 428/174 |
| 2007/0262634 | A1* | 11/2007 | Brill | A47C 7/28 297/452.15 |
| 2009/0064536 | A1* | 3/2009 | Klassen | A43B 13/181 36/27 |
| 2010/0058536 | A1* | 3/2010 | Fromme-Ruthmann | A47C 7/027 5/231 |
| 2012/0025576 | A1* | 2/2012 | Stern | F16F 1/185 297/344.1 |
| 2012/0066834 | A1* | 3/2012 | Jansen | A47C 23/002 5/239 |
| 2012/0168997 | A1* | 7/2012 | Jansen | A47C 23/002 267/85 |
| 2013/0228959 | A1* | 9/2013 | Bock | A47C 23/002 267/80 |
| 2013/0298332 | A1* | 11/2013 | Vanstraelen | A47C 23/067 5/618 |
| 2014/0345050 | A1 | 11/2014 | Lobry | |
| 2017/0347808 | A1* | 12/2017 | Fromme-Ruthmann | A47C 23/04 |

FOREIGN PATENT DOCUMENTS

| | | | | |
|---|---|---|---|---|
| EP | 2489288 | A1 | 8/2012 | |
| FR | 2790929 | A1 * | 9/2000 | A47C 23/00 |
| FR | 2859891 | A1 | 3/2005 | |
| FR | 2914164 | A1 | 10/2008 | |
| FR | 3005400 | A1 | 11/2014 | |

* cited by examiner

ONE-PIECE MATTRESS SUSPENSION DEVICE

CROSS-REFERENCE TO RELATED APPLICATION

This application claims priority to French Patent Application No. 1553944 filed Apr. 30, 2015, the disclosure of which is hereby incorporated in its entirety by reference.

BACKGROUND OF THE INVENTION

Field of the Invention

The present invention relates to the fields of furnishing and bedding, and more particularly to the field of suspension devices for interposing between a mattress and a support structure.

Description of Related Art

In order to suspend mattresses of beds or seats comfortably, it has been conventional to use devices constituted by slats that are fastened by their ends to two side rails of a bed or seat frame. Such slats support the mattress directly, over its entire width, thereby providing good continuity of support for the user in the width direction of the frame.

Nevertheless, such devices with slats present the drawback of flexing and of drooping significantly in the central portions of the slats under the weight of the user when the user is lying in the central portion. This leads to a lack of comfort for the user who, once lying in the central portions of the slats, becomes confined in those central portions, which form a depression.

In order to mitigate that problem, it is known to replace the slats with studs that provide the mattress with support spots. Unfortunately, in comparison with slats, such spot bearing surfaces present the drawback of leading to discontinuity in the support of the user in the width direction of the frame. This discontinuity can be detrimental to the impression of comfort given by that type of suspension device, in particular when the user turns over and moves in the width direction of the frame.

Support devices capable of attenuating the drooping of conventional slat devices, while conserving a certain degree of continuity in the support of the mattress in the width direction of the frame have already been proposed, in particular in French patent application publications numbers FR 3 005 400 et FR 2 914 164. Nevertheless, those devices are complex in shape, being made up of assemblies of a plurality of parts, thus making them relatively complex and expensive to produce. A one-piece device is proposed in publication FR 2 859 891, but its fabrication also requires several steps. Other one-piece devices are also disclosed in German patent DE 10 2012 107887 B3, in the publication of European patent application EP 2 489 288 A1, and in German utility certificate DE 20 2007 000158 U1.

SUMMARY OF THE INVENTION

The present disclosure seeks to remedy those drawbacks, and more specifically to propose a one-piece suspension device for interposing between a mattress and a support structure that is capable of being manufactured more simply and inexpensively while providing better comfort.

In at least one embodiment, this object is achieved by the fact that the one-piece device comprises a platform defining a bearing plane for the mattress, a fastener point for fastening to the support structure, and a resilient section that is more resilient than the platform in a direction perpendicular to the bearing plane and that is interposed between the platform and the fastener point in the direction perpendicular to the bearing plane for absorbing compression forces, and is shaped in such a manner that any axis perpendicular to said bearing plane passing through the one-piece suspension device intersects the one-piece suspension device along a single axis segment. There thus exists a bijective (one-to-one) relationship between points of a projection of the one-piece suspension device on said bearing plane and intersection segments of axes perpendicular to the bearing plane with the one-piece suspension device: to each projection point there corresponds only one intersection segment. In order to provide a linkage suitable for absorbing a compression force on the one-piece suspension device and thereby provide a high level of comfort, the resilient section may include at least one angled element having a first arm and a second arm, a first elastic hinge at a first end of the first arm, and a second elastic hinge that is more flexible than the first elastic hinge connecting a second end of the first arm to the second arm, the angled element forming a bend in such a manner that the first arm presents an angle relative to said bearing plane that is more pronounced than an angle presented by the second arm.

By means of these provisions, it is possible to produce the one-piece device in a single molding step in a mold that opens perpendicularly to the bearing plane. Unmolding is possible, even with a mold that has only two elements.

An additional advantage of this configuration lies in the handling and in the logistical management of a plurality of such one-piece devices, since this configuration makes them stackable, thereby significantly reducing their storage volume.

In order to accommodate the fastener point and the resilient section while complying with this configuration, the platform may present an opening facing the fastener point and the resilient section in the direction perpendicular to the bearing plane.

The resilient section may in particular have at least two angled elements arranged symmetrically to each other about a plane of symmetry perpendicular to said bearing plane.

In order to facilitate unmolding, the top arm and the bottom arm of each angled element may slope in the same direction relative to the bearing plane. Nevertheless, a configuration in which the top arm and the bottom arm of each angled element slope in opposite directions relative to the bearing plane can also be envisaged, and that facilitates flexing of the angled element under compression.

In order to facilitate fabrication, in particular by injection molding, the one-piece device may be made of thermoplastic material. Also, in order to obtain good resilience and damping capacity, the one-piece device may be made of elastomer material. It is possible to use materials that are simultaneously thermoplastics and elastomers, such as for example a thermoplastic elastomer copolyester.

In order to facilitate fastening to the support structure, e.g. by means of a single screw, a fastener orifice may be formed at the fastener point. The fastener point may be situated on a base that is distinct from the resilient section, or else on the resilient section itself. Also, in order to facilitate the flow of air through the mattress, the platform may present ventilation orifices.

Typically, such suspension devices are fastened side-by-side on cross members of a bed or seat frame structure. In order to facilitate such an arrangement, the platform may present an outline that is rectangular. The term "rectangular" is used in this context to designate any outline having four sides at right angles, including outlines that are square. Furthermore, the right angled corners may be rounded or chamfered.

The present disclosure also relates to a one-piece module comprising at least one one-piece device as mentioned above. In particular, the one-piece module may comprise a plurality of said one-piece devices in alignment on a direction that is parallel to said bearing plane and connected together via their respective platforms, thereby enabling them to be fastened on a common crossmember. Nevertheless, it is also possible to fasten the one-piece suspension devices of a given module on different crossmembers. In order to increase modularity, the one-piece suspension devices of a given one-piece module having a plurality of one-piece suspension devices may be identical to one another.

The present disclosure also relates to an assembly comprising a support structure and at least one one-piece module of the above-mentioned kind fastened to the support structure. In particular, the assembly may comprise a plurality of such one-piece modules fastened on a single face of a single crossmember of the support structure, although it is also possible to envisage fastening a single one-piece module that extends over the entire length of such a crossmember. Nevertheless, when the assembly comprises a plurality of one-piece modules, the plurality may comprise one-piece modules of different sizes, and in particular incorporating different numbers of one-piece suspension devices that are identical to one another, in order to provide modularity making it easy to adapt to support structures of different sizes. By way of example, the support structure may be a conventional bed frame structure comprising two side rails extending in a longitudinal direction, and a plurality of crossmembers connecting the two side rails together transversely.

BRIEF DESCRIPTION OF THE DRAWINGS

The invention can be well understood and its advantages appear better on reading the following detailed description of embodiments shown as a nonlimiting examples. The description refers to the accompanying drawings, in which.

DESCRIPTION OF THE INVENTION

Figure 1:
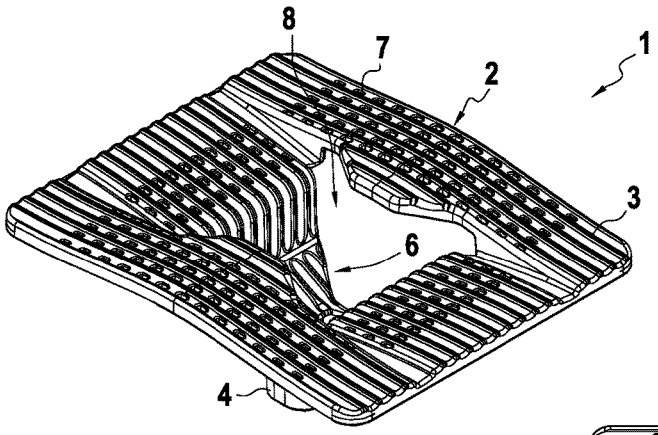
FIG. 1 is a perspective view of a one-piece module in a first embodiment.

FIGS. 1 and 2A to 2C show a first embodiment of a one-piece module 1 comprising a single one-piece suspension device 2 for interposing between a mattress and a support structure in a bed or the seat of a piece of furniture such as a couch or a sofa. This one-piece suspension device 2 comprises a platform 3 defining a bearing plane A for the mattress, a base 4 having a fastener orifice 5 for fastening to a fastener point, and a resilient section 6 that is more resilient than the platform 3 in the direction perpendicular to the bearing plane A and that is interposed between the platform 3 and the base 4 in the direction perpendicular to the bearing plane A in order to absorb compression forces. In the embodiment shown, the one-piece module 1 may be made as a single piece of thermoplastic elastomer material, e.g. a thermoplastic elastomer copolyester, by a method such as injection molding. As shown in particular in FIG. 2A, the platform 3 may have a rectangular outline with rounded corners and a plurality of ventilation orifices 7, and also a central opening 8 facing the resilient section 6 and the base 4 in a direction perpendicular to the bearing plane A.

Figure 2A:
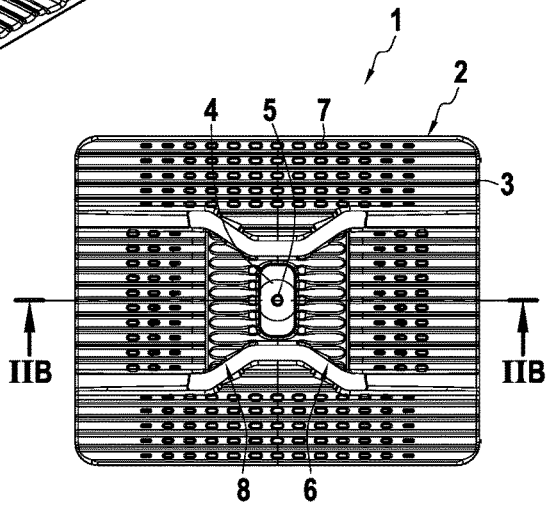
FIG. 2A is a view of the top of the FIG. 1 module.
Figure 2B:
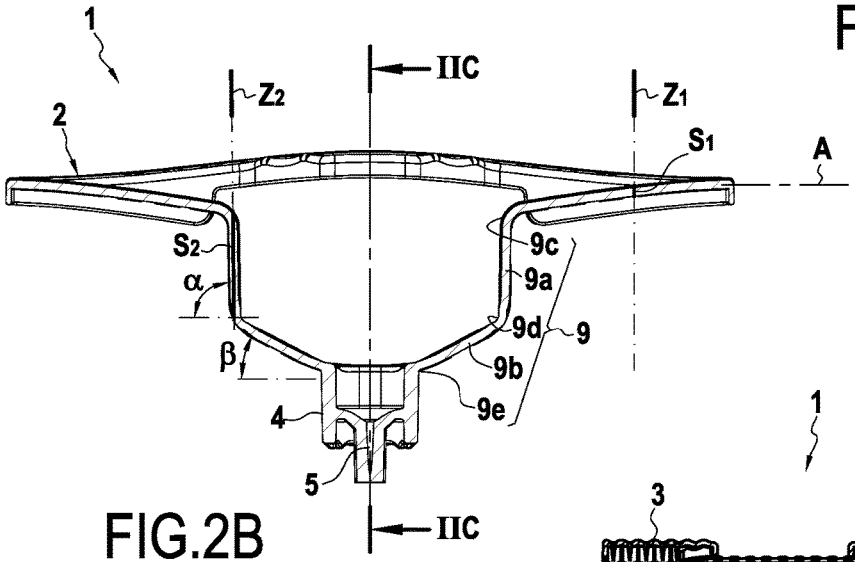
FIGS. 2B and 2C are section views of the FIG. 1 module on respective section planes IIB-IIB in FIG. 2A and IIC-IIC in FIG. 2B.
Figure 2C:
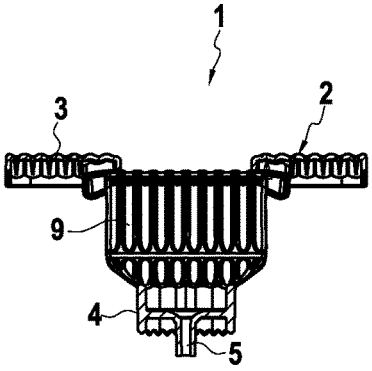

As shown in particular in FIG. 2B, the resilient section 6 is made up of two angled elements 9 arranged symmetrically relative to each other about a plane of symmetry IIC-IIC perpendicular to said bearing plane A. Each of these angled elements 9 has a first arm 9*a* and a second arm 9*b*. In the embodiment shown, the first arm 9*a* has a first end connected to the platform 3 by a first elastic hinge 9*c* and extends towards the base 4 at an angle α [ALPHA] that is a right angle or nearly a right angle relative to the bearing plane A. In particular, this angle α [ALPHA] may lie in the range 80° to 90°, for example.

A second end of the first arm 9*a* is connected to the second arm 9*b* by a second elastic hinge 9*d* forming an angled bend, in such a manner that the second arm 9*b* extends towards the base 4 at an angle β [BETA] that is substantially less than the angle α [ALPHA] relative to the bearing plane A. In particular, in the embodiment shown, this angle β [BETA] may lie in the range 0° to 60°. A third elastic hinge 9*e* in turn connects the second arm 9*b* to the base 4.

As shown in FIG. 2B, by means of this configuration, any axis $Z_1$ or $Z_2$ perpendicular to said bearing plane A passing through the one-piece suspension device 2 intersects the one-piece suspension device 2 along a single corresponding intersection segment $S_1$, $S_2$. The relationship between points of a projection of the one-piece suspension device 2 onto said bearing plane A, such as that shown in FIG. 2A, and intersection segments of axes perpendicular to the bearing plane A with the one-piece suspension device is thus bijective (one-to-one): to each point of the projection there corresponds a single intersection segment. The one-piece device thus does not have any undercuts. This presents several advantages: firstly, unmolding along an axis perpendicular to the bearing plane A is thus facilitated compared with unmolding a module presenting undercuts in this direction, and secondly, such modules are thus stackable, and therefore easier to store and transport in large quantities.

Figure 3:
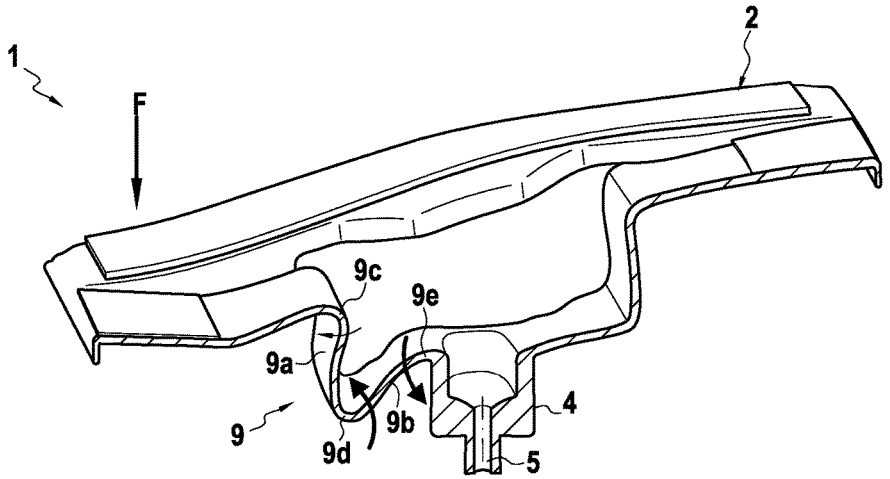
FIG. 3 is a diagrammatic view of the FIG. 1 module deformed by a force F.

In order to facilitate elastic deformation of the resilient section 6 in this configuration, and thus provide good suspension for the mattress supported by the platform 3, the first elastic hinge 9*c* is stiffer than the second and third elastic hinges 9*d* and 9*e*. When a force F is exerted between the platform 3 and the base 4 along an axis perpendicular to said bearing plane A, the angular deflection is thus greater at the second and third elastic hinges 9*d*, 9*e* than it is at the first elastic hinge 9*c*, thereby reducing the angle of the bend formed between the first arm 9*a* and the second arm 9*b* under this load, as shown in FIG. 3. When the force F ceases to act on the platform 3, the elastic hinges 9*c* to 9*e* will relax, thereby returning the resilient section 6 to its initial position. The viscoelastic nature of the elastomer forming the one-piece suspension device 2 provides this elastic return together with appropriate damping of the bending and relaxation movements of the angled elements 9 of the resilient section 6.

Figure 4:
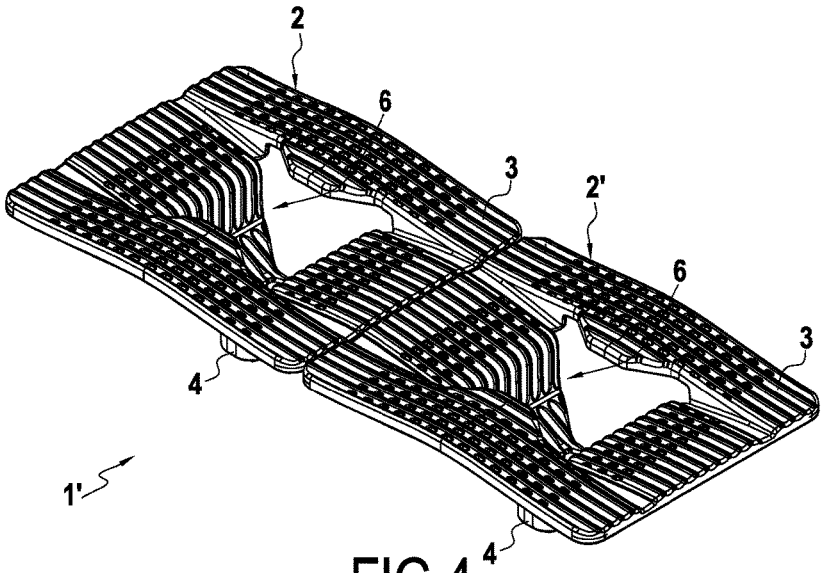
FIG. 4 is a perspective view of a one-piece module in a second embodiment.
Figure 5:
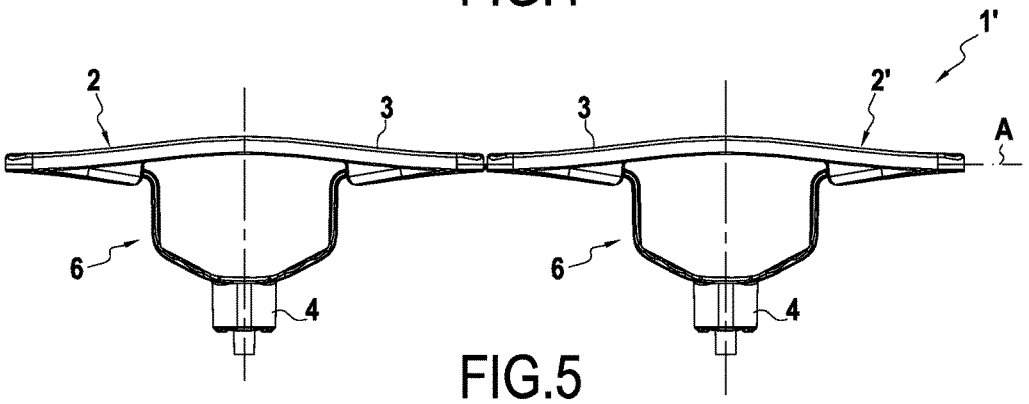
FIG. 5 is a view of the side of the FIG. 4 module.
Figure 6:
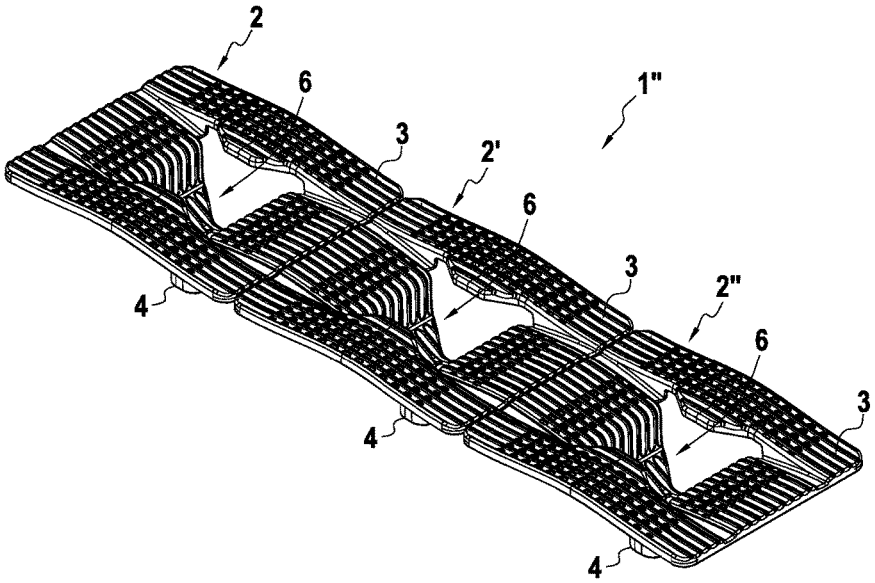
FIG. 6 is a perspective view of a one-piece module in a third embodiment.
Figure 7:
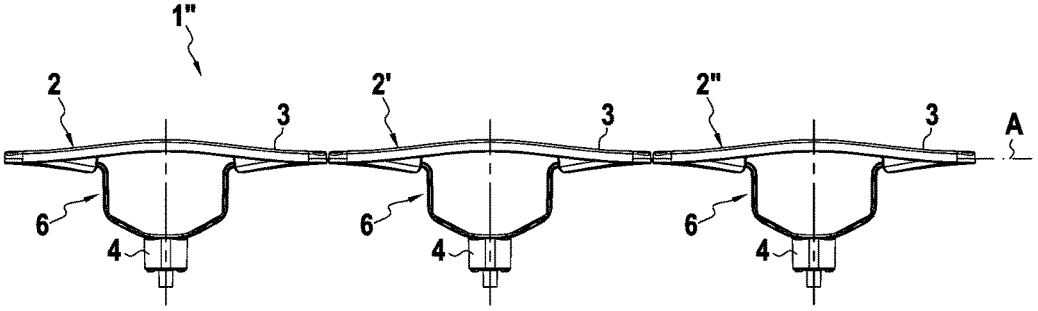
FIG. 7 is a view of the side of the FIG. 6 module.

Although in this first embodiment, the one-piece module 1 has only a single one-piece suspension device 2, it is also possible to include a plurality of said one-piece suspension devices in a single one-piece module. Thus, in the embodiment shown in FIGS. 4 and 5, a single one-piece module 1' has two identical one-piece suspension devices 2, 2'. Each of the two one-piece suspension devices 2, 2' comprises the same elements as in the first embodiment, and consequently they are given the same reference numerals in the drawings. The two one-piece suspension devices 2, 2' are connected together via their platforms 3, so as to support the mattress in parallel. They are in alignment in a direction parallel to their common bearing plane A, so as to enable them to be fastened on the same crossmember. In the embodiment shown in FIGS. 6 and 7, a single one-piece module 1" even has three one-piece suspension devices 2, 2', 2", each likewise having the same elements as in the first embodiment, which elements thus receive the same reference numerals in the drawings. As in the above embodiment, the one-piece suspension devices 2, 2', 2" are connected together by their platforms 3, and they are in alignment in a direction parallel to their common bearing plane A, so as to enable them to be fastened on the same crossmember.

Figure 8:
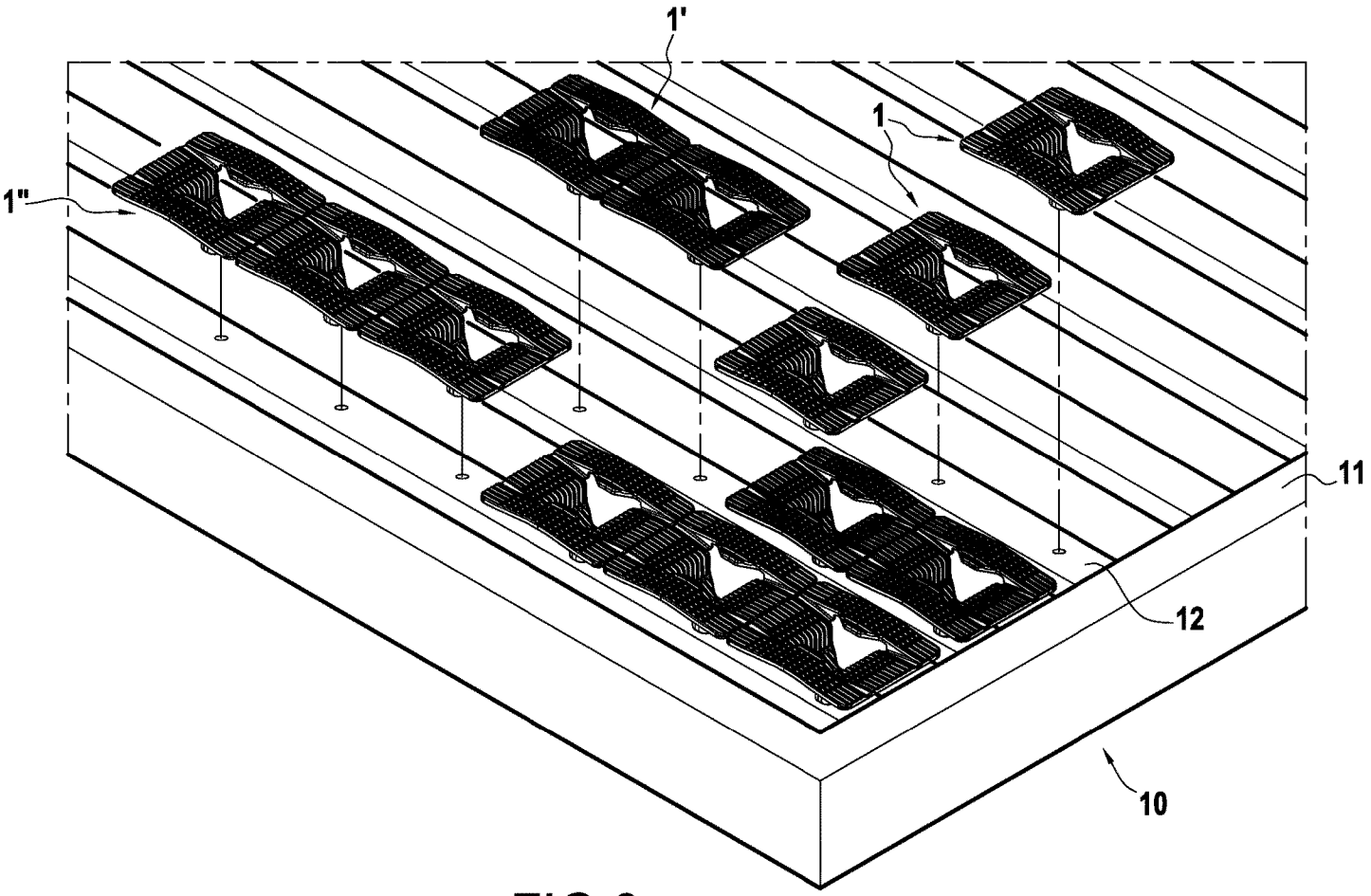
FIG. 8 is a perspective view of an assembly comprising a support structure and a plurality of support modules of the first three embodiments.

The availability of modules of different sizes incorporating one or more one-piece suspension devices makes them easier to fit to support structures of different widths. FIG. 8 shows an embodiment of an assembly comprising a support structure 10 and a plurality of one-piece modules 1, 1', 1" fastened on said support structure 10 by screws (not shown) passing through the fastener orifices 5 in the bases 4 of each of the one-piece suspension devices 2, 2', 2". The support structure 10 comprises a frame with two side rails 11 extending in a longitudinal direction, and a plurality of crossmembers 12 connecting these side rails 11 together transversely. The one-piece modules 1, 1', 1" are fastened to the outside face of each crossmember 12, in alignment along the crossmembers 12 with a common bearing plane A for supporting the mattress. It is possible to combine modules 1, 1', 1" of different sizes incorporating one or more one-piece suspension devices in order to cover the support structure 10 over its entire width. The rectangular shape of the platform 3 makes it possible for the surface of the support structure 10 to be well filled in the bearing plane A. Although in the example shown the one-piece modules 1', 1" are oriented along the crossmembers 12 so that each one-piece module 1', 1" is fastened to a single crossmember 12, it is also possible to envisage giving these one-piece modules 1', 1" a different orientation, e.g. such as a longitudinal orientation orthogonal to the orientation of the crossmembers 12, so as to fasten each one-piece suspension device 2, 2', 2" of a one-piece module 1', 1" oriented in this way on a different crossmember 12.

Figure 9:
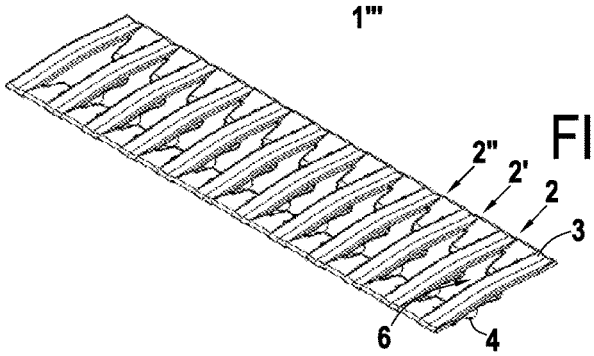
FIG. 9 is a perspective view of a one-piece module in a fourth embodiment.
Figure 10A:
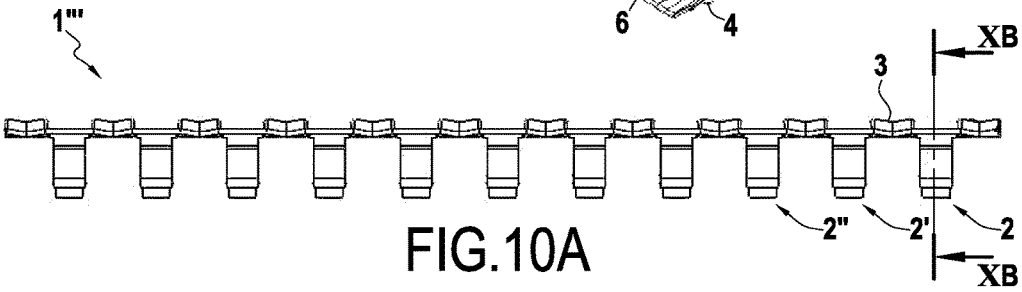
FIG. 10A is a view of the side of the FIG. 9 module.
Figure 10B:
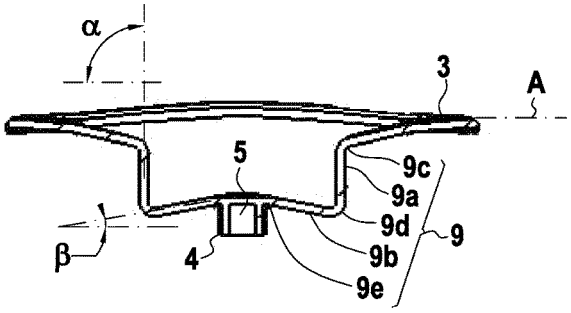
FIG. 10B is a section view of the FIG. 9 module on plane XB-XB in FIG. 10A.

Although in each of the above embodiments, the first arm 9*a* and the second arm 9*b* of each angled element 9 slopes in the same direction relative to the bearing plane A, it is possible to envisage an alternative configuration in which they slope in opposite directions, in such a manner that the fastener element is raised relative to the bend-forming elastic hinge 9*d*. This is a configuration of the fourth embodiment, as shown in FIGS. 9, 10A, and 10B, where elements that are equivalent to those of the above embodiments are given the same reference numerals. Furthermore, this fourth embodiment, in which the one-piece module 1" has a plurality of one-piece suspension devices 2, 2', 2", also differs from the second and third embodiments in that the bending planes of the angled elements 9 are perpendicular to the direction in which the one-piece suspension devices 2, 2', 2" of the one-piece module 1" are in alignment.

Figure 11:
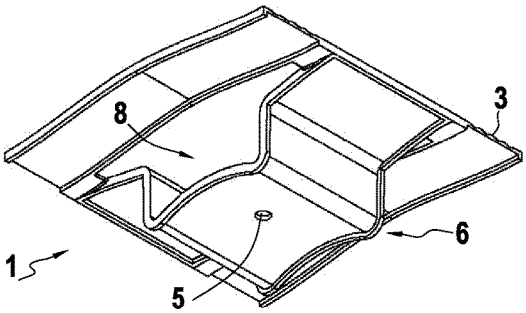
FIG. 11 is a perspective view of a one-piece module in a fifth embodiment.
Figure 12:
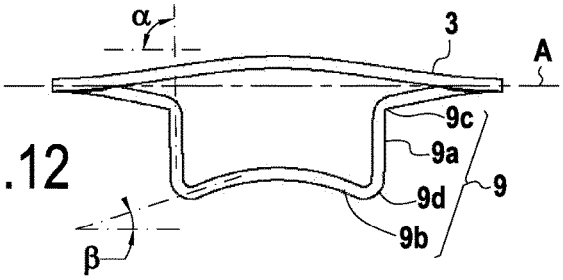
FIG. 12 is a view of the side of the one-piece module of FIG. 11.

Although in each of the above embodiments the fastener element of each one-piece suspension device is formed on a distinct base of the resilient section, it may also be formed in the resilient section itself. Thus, in a fifth embodiment, as shown in FIGS. 11 and 12, where elements that are equivalent to those of the above embodiments are given the same reference numerals, the second arms 9*b* of the two symmetrical angled elements 9 are not connected to distinct bases by third elastic hinges, but are directly connected to each other, and the fastener orifice 5 is formed at their junction. As in the fourth embodiment, the first and second arms 9*a* and 9*b* of each angled element 9 slope in opposite directions relative to the bearing plane A, in such a manner that the fastener orifice 5 is raised relative to the second elastic hinges 9*d*. This embodiment also presents the advantage of enabling the resilient section 6 to be prestressed while it is being fastened on a flat surface, thereby straightening the bottom arms 9*b* and beginning to fold the second elastic hinges 9*d*.

Figure 13:
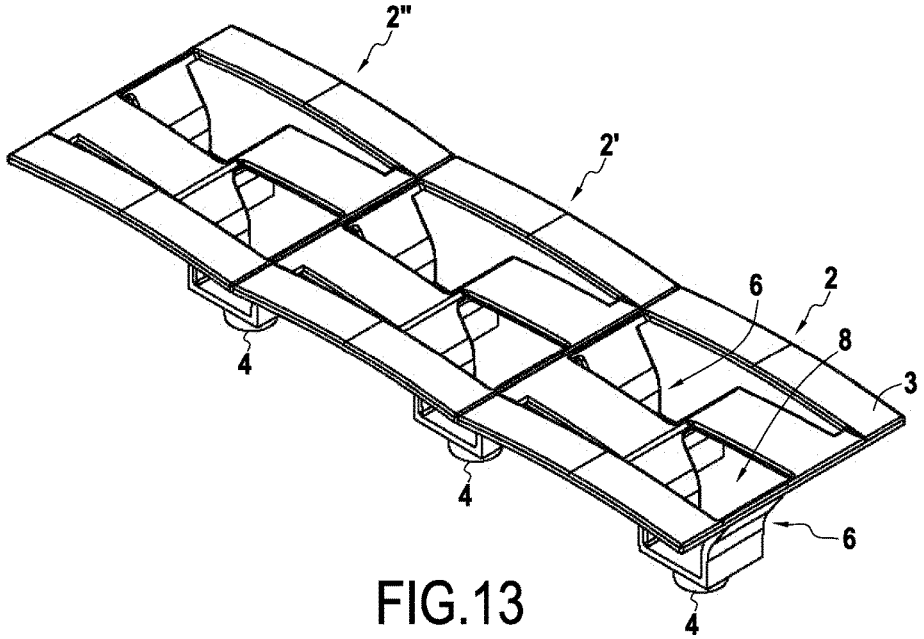
FIG. 13 is a perspective view of a one-piece module in a sixth embodiment.
Figure 14:
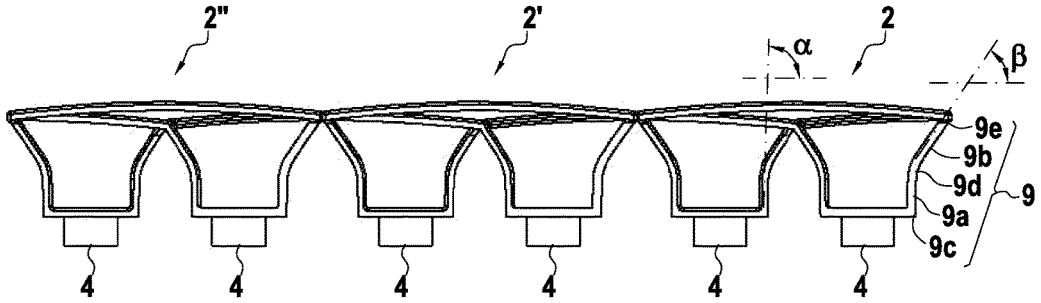
FIG. 14 is a view of the side of the one-piece module of FIG. 13.

Although in each of the above embodiments, each one-piece suspension device has only one fastener point and only one resilient section, one-piece suspension devices each having a plurality of fastener points, with respective individual resilient sections interposed between each fastener point and the platform can also be envisaged. Thus, in a sixth embodiment shown in FIGS. 13 and 14, each one-piece suspension device 2, 2', 2" of the one-piece module 1" has two bases 4, each having a fastener orifice 5 at a fastener point, and each connected to the platform 3 by a corresponding resilient section 6. The two bases 4 of each one-piece suspension device 2, 2', 2" are offset relative to one another in a direction perpendicular to the direction in which the one-piece suspension devices 2, 2', 2" of the one-piece module 1" are in alignment, such that the bases 4 of the one-piece module 1" are in staggered rows.

The resilient sections 6 in this sixth embodiment also differ from those of the above embodiments in that their arrangement is inverted, with the first arm 9*a* connected to the corresponding base 4 by the first elastic hinge 9*c* and with the second arm 9*b* connected to the platform 3 by the third elastic hinge 9*e*. The angled elements 9 of each symmetrical pair are thus bent towards each other rather than towards the outside as in the above embodiments. Nevertheless, the operation of these resilient sections 6 is analogous, and all of the elements of the one-piece module in FIGS. 13 and 14 thus receive the same reference numerals as the equivalent elements in the above embodiments.

Although the present invention is described with reference to specific embodiments, it is clear that various modifications and changes can be made to these embodiments without going beyond the general ambit of the invention as defined by the claims. Also, individual characteristics of the various embodiments mentioned may be combined in additional embodiments. For example, the angled elements in the first three embodiments could be inverted as in the sixth embodiment, but without simultaneously adopting the staggered row configuration of the sixth embodiment. Consequently, the description and the drawings should be considered in a sense that is illustrative rather than restrictive.

The invention claimed is:

1. A one-piece suspension device for interposing between a mattress and a support structure, the device comprising:

a platform defining a bearing plane for the mattress;

a fastener point for fastening to the support structure; and a resilient section that is more resilient than the platform in a direction perpendicular to the bearing plane, being interposed between the platform and the fastener point in the direction perpendicular to the bearing plane in order to absorb compression forces, and including an angled element having a first arm and a second arm, a first elastic hinge at a first end of the first arm, and a second elastic hinge connecting a second end of the first arm to the second arm and forming a bend in such a manner that the first arm presents an angle relative to said bearing plane that is more pronounced than that presented by the second arm, the second elastic hinge being more flexible than the first elastic hinge; and the one-piece suspension device being shaped in such a manner that any axis perpendicular to said bearing plane and passing through the one-piece suspension device intersects the one-piece suspension device along a single intersection segment.

2. The one-piece suspension device according to claim 1, wherein the platform presents an opening facing the fastener point and the resilient section in the direction perpendicular to the bearing plane.

3. The one-piece suspension device according to claim 1, wherein the first arm and the second arm of the angled element slope in the same direction relative to the bearing plane.

4. The one-piece suspension device according to claim 1, wherein the first arm and the second arm of the angled element slope in opposite directions relative to the bearing plane.

5. The one-piece suspension device according to claim 1, wherein the resilient section has at least two angled elements arranged symmetrically to each other about a plane of symmetry perpendicular to said bearing plane.

6. The one-piece suspension device according to claim 1, made of thermoplastic material.

7. The one-piece suspension device according to claim 1, made of elastomer material.

8. The one-piece suspension device according to claim 1, made of thermoplastic elastomer copolyester.

9. The one-piece suspension device according to claim 1, wherein a fastener orifice is situated at the fastener point.

10. The one-piece suspension device according to claim 1, wherein the platform presents ventilation orifices.

11. The one-piece suspension device according to claim 1, wherein the platform presents an outline that is rectangular.

12. A one-piece module comprising a one-piece suspension device for interposing between a mattress and a support structure, the one-piece suspension device comprising:

a platform defining a bearing plane for the mattress;

a fastener point for fastening to the support structure; and a resilient section that is more resilient than the platform in a direction perpendicular to the bearing plane, being interposed between the platform and the fastener point in the direction perpendicular to the bearing plane in order to absorb compression forces, and including an angled element having a first arm and a second arm, a first elastic hinge at a first end of the first arm, and a second elastic hinge connecting a second end of the first arm to the second arm and forming a bend in such a manner that the first arm presents an angle relative to said bearing plane that is more pronounced than that presented by the second arm, the second elastic hinge being more flexible than the first elastic hinge; and the one-piece suspension device being shaped in such a manner that any axis perpendicular to said bearing plane and passing through the one-piece suspension device intersects the one-piece suspension device along a single intersection segment.

13. A one-piece module comprising a plurality of one-piece suspension devices for interposing between a mattress and a support structure, each one-piece suspension device comprising:

a platform defining a bearing plane for the mattress;

a fastener point for fastening to the support structure; and a resilient section that is more resilient than the platform in a direction perpendicular to the bearing plane, being interposed between the platform and the fastener point in the direction perpendicular to the bearing plane in order to absorb compression forces, and including an angled element having a first arm and a second arm, a first elastic hinge at a first end of the first arm, and a second elastic hinge connecting a second end of the first arm to the second arm and forming a bend in such a manner that the first arm presents an angle relative to said bearing plane that is more pronounced than that presented by the second arm, the second elastic hinge being more flexible than the first elastic hinge;

each one-piece suspension device being shaped in such a manner that any axis perpendicular to said bearing plane and passing through the one-piece suspension device intersects the one-piece suspension device along a single intersection segment; and said one-piece suspension devices are in alignment in a direction parallel to said bearing plane and are connected together by their respective platforms.

14. The one-piece module according to claim 13, wherein said one-piece suspension devices are identical.

15. An assembly comprising a support structure and a one-piece module fastened on the support structure, the one-piece module comprising a one-piece suspension device for interposing between a mattress and a support structure, the one-piece suspension device comprising:

a platform defining a bearing plane for the mattress;

a fastener point for fastening to the support structure; and a resilient section that is more resilient than the platform in a direction perpendicular to the bearing plane, being interposed between the platform and the fastener point in the direction perpendicular to the bearing plane in order to absorb compression forces, and including an angled element having a first arm and a second arm, a first elastic hinge at a first end of the first arm, and a second elastic hinge connecting a second end of the first arm to the second arm and forming a bend in such a manner that the first arm presents an angle relative to said bearing plane that is more pronounced than that presented by the second arm, the second elastic hinge being more flexible than the first elastic hinge, the one-piece suspension device being shaped in such a manner that any axis perpendicular to said bearing plane and passing through the one-piece suspension device intersects the one-piece suspension device along a single intersection segment.

16. The assembly according to claim 15, comprising a plurality of one-piece modules fastened on a single face of a single crossmember of the support structure.

17. The assembly according to claim 16, wherein said plurality of one-piece modules includes one-piece modules of different sizes.

18. The assembly according to claim 15, wherein said support structure comprises two side rails extending in a longitudinal direction, and a plurality of crossmembers connecting the two side rails together transversely.

* * * * *